US007362317B2

(12) United States Patent
Yu

(10) Patent No.: US 7,362,317 B2
(45) Date of Patent: Apr. 22, 2008

(54) DRIVING CIRCUIT FOR FLAT DISPLAY PANEL

(75) Inventor: Jian-Shen Yu, Hsinchu (TW)

(73) Assignee: AU Optronics Corp., Hsinchu (TW)

( * ) Notice: Subject to any disclaimer, the term of this patent is extended or adjusted under 35 U.S.C. 154(b) by 553 days.

(21) Appl. No.: 10/692,741

(22) Filed: Oct. 27, 2003

(65) Prior Publication Data

US 2004/0174351 A1 Sep. 9, 2004

(30) Foreign Application Priority Data

Mar. 5, 2003 (TW) ..... 92104630 A

(51) Int. Cl.
*G09G 5/00* (2006.01)

(52) U.S. Cl. ..... 345/204; 345/92; 345/93; 345/98; 345/99; 345/100; 345/214

(58) Field of Classification Search ..... 345/87–104, 345/204–215, 690
See application file for complete search history.

(56) References Cited

U.S. PATENT DOCUMENTS 4,481,511 A * 11/1984 Hanmura et al. ..... 345/100
5,151,689 A * 9/1992 Kabuto et al. ..... 345/103
6,011,607 A * 1/2000 Yamazaki et al. ..... 349/153
6,177,916 B1 * 1/2001 Aoki et al. ..... 345/87
6,355,942 B1 * 3/2002 Yamazaki et al. ..... 257/72

* cited by examiner

*Primary Examiner*—Vijay Shankar
(74) *Attorney, Agent, or Firm*—Bacon & Thomas, PLLC

(57) ABSTRACT

This invention relates to a driving circuit for flat panel displays wherein the driving circuit is disposed on a flat panel display panel. The circuit has a plurality of signal lines, at least one buffer unit for inverting a scanning signal, a plurality of switch units and an active area (display area). The plurality of signal lines supplies a plurality of analogous video signals to the plurality of switch units. The unit for inverting a scanning signal generates at least a scanning signal which is then outputted to the plurality of switch units. The analogous video signal so received is transformed into the active-matrix display area by controlling the operation of the plurality of switch units.

16 Claims, 6 Drawing Sheets

| | prior art | example 1 | example 2 |
|---|---|---|---|
| video line(blue) | 4 | 3 | 4 |
| video line(red) | 4 | 3 | 4 |
| video line(green) | 4 | 3 | 2 |
| total | 12 | 9 | 10 |

FIG. 4

DRIVING CIRCUIT FOR FLAT DISPLAY PANEL

BACKGROUND OF THE INVENTION

1. Field of the Invention

The present invention relates to a driving circuit, and in particular, a driving circuit disposed on a flat panel display panel.

2. Description of Related Art

Flat panel displays have been widely applied to the display of monitors or electronic products, due to the development of the photoelectric industry. The state of the art in the field of the flat panel displays has a driving circuit, thin-film transistors and necessary circuits disposed on a glass substrate. FIG. 1 shows a schematic diagram of the conventional circuit for sampling/sustaining video signals of a display pixel. The circuit for sampling/sustaining video signals is disposed on a substrate, and analogous switches 111, 112, 113 are disposed between signal lines 121, 122, 123 and active area (display area) 131. The control gate of the analogous switches 111, 112, 113 is respectively connected to the input and output terminals of an inverter circuit 141. The inverter circuit 141 is an output buffer for a sampling signal generator. The input terminal of the inverter circuit 141 is connected to a sampling signal generator (not shown). Hence, a pair of complementary sampling signals are outputted to control the operation of the analogous switches 111, 112, 113 respectively. The analogous switches 111, 112, 113 are connected to the video signal lines 121, 122, 123 respectively to receive analogous video signals.

When the analogous switches 111, 112 113 are physically connected to the inverter circuit 141, and the video signal lines 121, 122, 123, crossover points 151 and 152 in FIG. 1, for example, between lines by intersection other than connection occur on the signal lines 121 and 123, respectively. It is realized that more crossover points than the points 151 and 152 as shown in the schematic diagram exist in practice. For each video line, a parasitic capacitance occurs on the crossover point, which will result in unwanted power consumption and may cause poor picture quality. Hence, there is a dire need to adequately dispose of the analogous switches 111, 112, 113, the sampling buffer circuit (i.e., the inverter circuit 141) and the signal lines 121, 122, 123 to decrease the quantity of the parasitic capacitances on the video signal lines.

SUMMARY OF THE INVENTION

The primary object of the present invention is to provide a driving circuit for a flat display panel to decrease the number of the parasitic capacitances on video lines so as to improve picture quality and to decrease power consumption.

To attain the above-mentioned object, a driving circuit for a flat display panel according to the present invention comprises a plurality of video signal lines for providing analogous video signals, at least one buffer unit for inverting a scanning signal, and a plurality of switch units disposed between the video signal lines. Each of the switch units is connected to one of the video signal lines to receive an analogous video signal, and also, is connected to the output terminal of the buffer unit. A scanning signal enables the operation of the plurality of switch units so that a video signal is outputted to the display area (active area) of the flat display panel.

The disposition between the plurality of switch units of the driving circuit and the display area of the flat panel display panel according to the present invention is not specifically defined. Preferably, the plurality of switch units and the display area of the flat display panel are spaced apart with at least one video signal line. The disposition of the video signal lines of the driving circuit according to the present invention is not specifically defined. Preferably, at least one video signal line is disposed between the switch units and the buffer unit for inverting a scanning signal. The disposition between the video signal lines and the switch units of the driving circuit according to the present invention is not specifically defined. Preferably, the video signal lines are disposed between the switch units and the display area. The buffer unit for inverting a scanning signal of the driving circuit according to the present invention is not specifically defined. Preferably, the buffer unit for inverting a scanning signal is an amplification circuit, and more preferably, an inverting amplification circuit, to receive a timing signal, and then, amplify the timing signal to output at least one scanning signal. The flat display panel adapted to the driving circuit according to the present invention is not specifically defined. Preferably, the flat display panel is an organic light-emitting diode (OLED) display, or a liquid crystal display (LCD). Specifically, the LCD is the most preferred.

Other objects, advantages, and novel features of the invention will become more apparent from the following detailed description when taken in conjunction with the accompanying drawings.

BRIEF DESCRIPTION OF THE DRAWINGS

FIG. 4 is a comparison table of the quantity of the parasitic capacitances according to whether the conventional driving circuit or the driving circuit according to the present invention is used.

DETAILED DESCRIPTION OF THE PREFERRED EMBODIMENT

Figure 1:
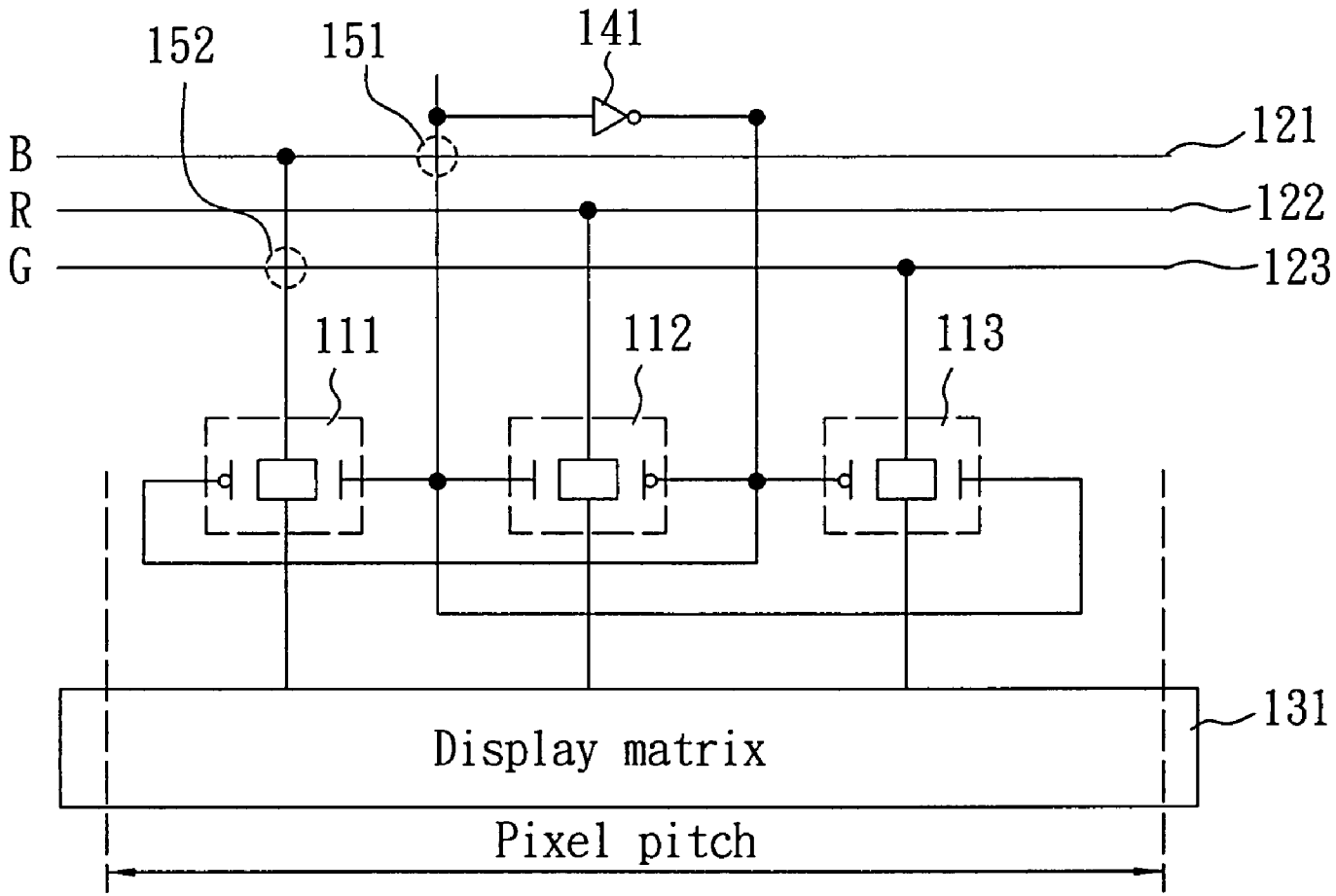
FIG. 1 is a schematic diagram of the conventional circuit for sampling/sustaining signals.
Figure 2A:
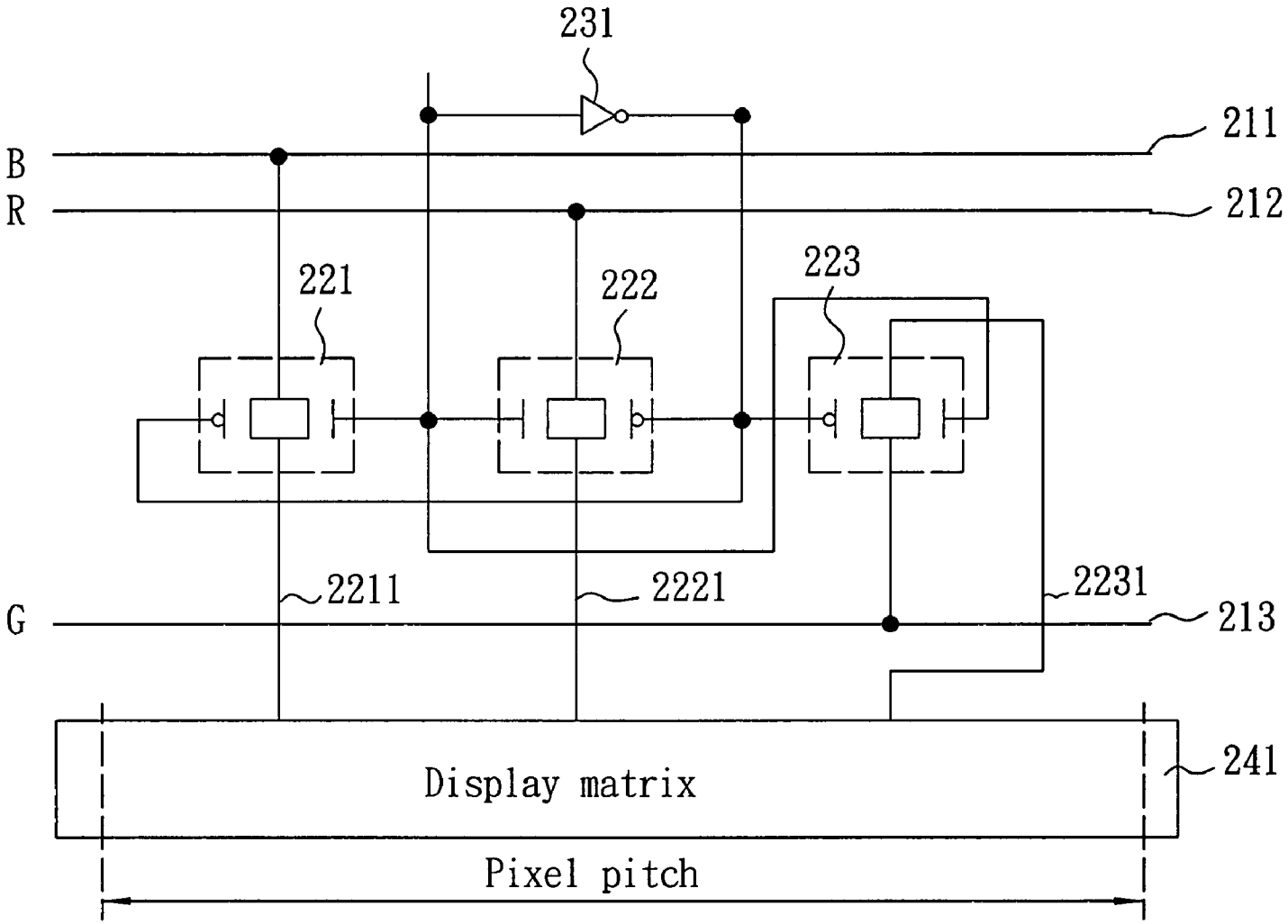
FIG. 2*a* is a schematic diagram of a driving circuit according to the first embodiment of the present invention.

With reference to FIG. 2*a*, a schematic diagram of a driving circuit for sample/sustenance according to the first embodiment of the present invention is shown. The circuit comprises a plurality of video signal lines 211, 212, 213, a plurality of switch units 221, 222, 223, a buffer unit for inverting a scanning signal 231 and a display area (an active area) 241. The plurality of video signal lines 211, 212, 213 supply analog video signals; for example, the video signal line 211 supplies an analog video signal for blue, the video signal line 212 supplies an analog video signal for red, and the video signal line 213 supplies an analog video signal for green.

In this embodiment, the buffer unit for inverting a scanning singnal 231 is preferably an inverter circuit. The input terminal of the inverter circuit is connected to a scanning signal generator (not shown). The scanning signal generator supplies a possitive phase timing signal to drive an N-type metal-oxide-silicon field-effect-transistor (NMOSFET) of the plurality of switch units 221, 222, 223. The buffer unit for inverting a scanning signal 231 receives the positive phase timing signal outputted from the scaning signal generator, and then, supplies an inverted signal (that is, a negative phase timing signal) to drive a P-type metal-oxide-silicon field-effect-transistor (PMOSFET) of the plurality of switch units 221,222,223.

In this embodiment, the plurality of switch units 221, 222, 223 can be of any electronic switches, and preferably, transistors, and more preferably, thin film transistors (TFTs). The plurality of switch units 221, 222, 223 are disposed between the video signal line 212 and the video signal line 213. Each n-type control gate of the switch units 221, 222, 223 is connected to the input terminal of the buffer unit and each p-type control gate of the switch units 221, 222, 223 is connected to the output terminal of the buffer unit 231. The switch units 221, 222, 223 are connected to the video signal lines 211, 212, 213 respectively. The scanning signals control the output of the plurality of switch units 221, 222, 223. With the arrival of the scanning signals, the plurality of switch units 221, 222, 223 output the video signals to data lines (not shown) in the active area (display area) 241 through output video signal lines 2211, 2221, 2231.

Figure 2B:
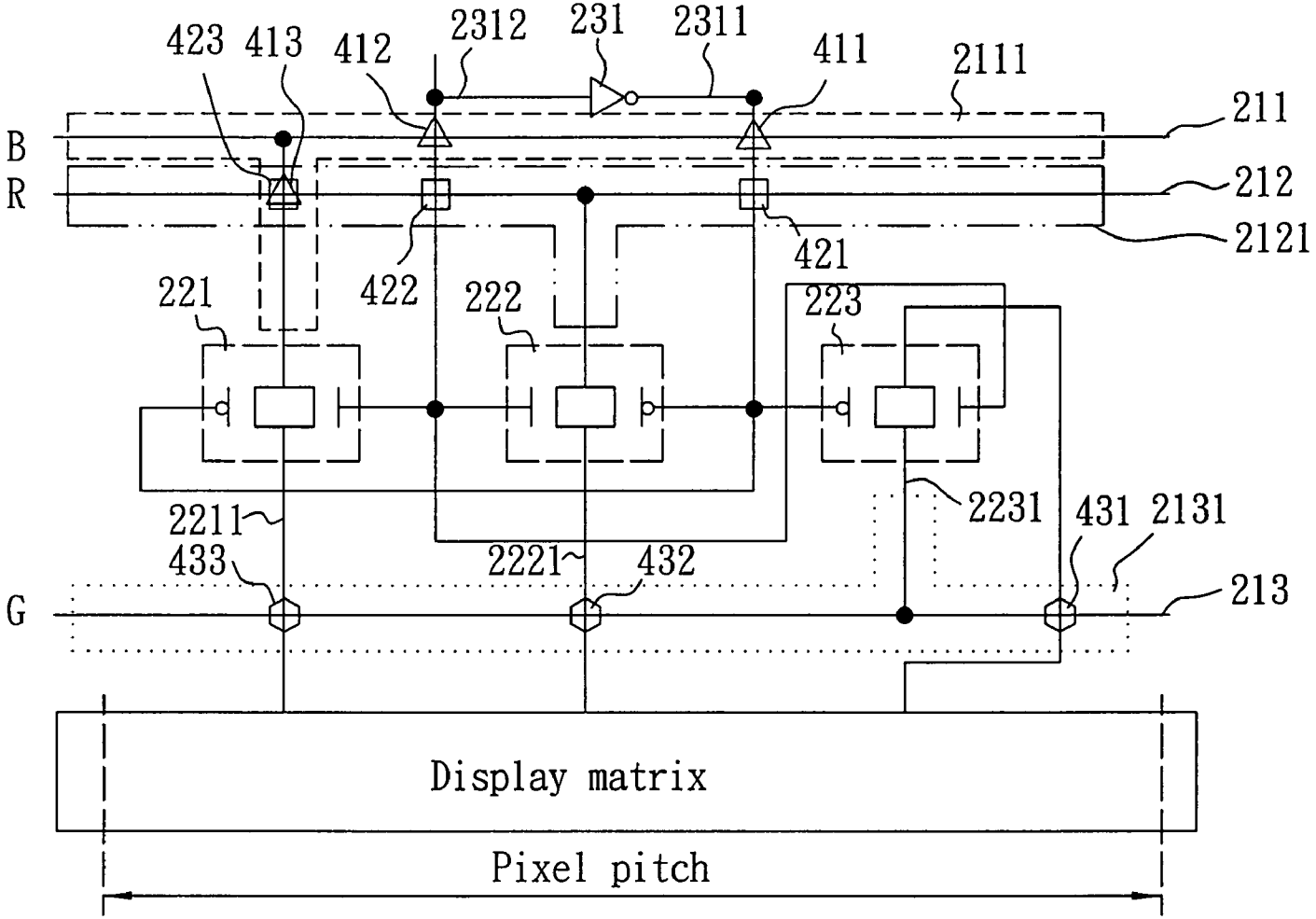
FIG. 2*b* is a schematic diagram of the parasitic capacitances associated with the first embodiment of the present invention.
Figure 3A:
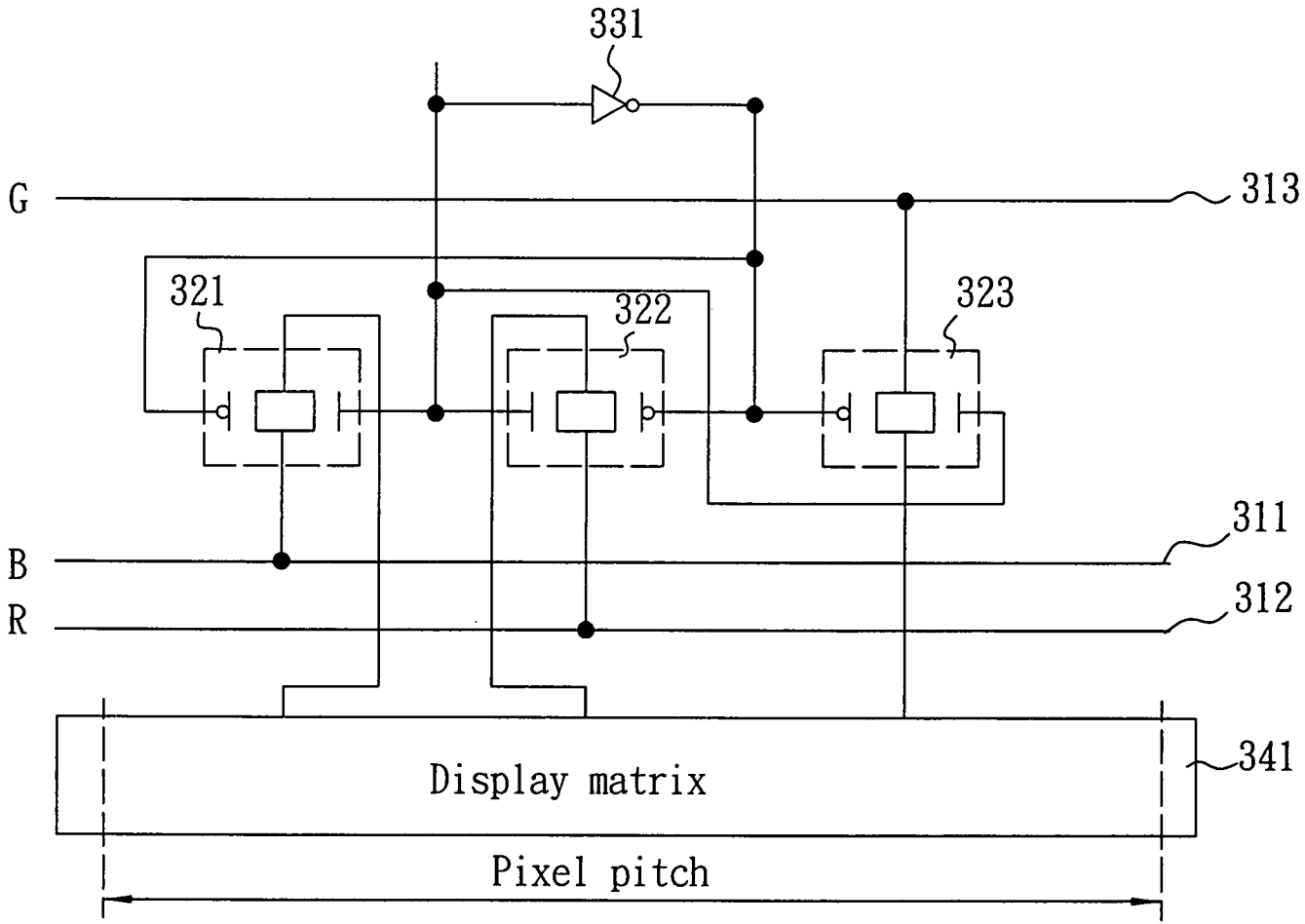
FIG. 3*a* is a schematic diagram of the driving circuit according to the second embodiment of the present invention.

FIG. 2*b* shows a schematic diagram of the parasitic capacitances associated with the first embodiment of the present invention. The parasitic capacitance per pixel length on the video line 211 comes from crossover points 411, 412, 413 (as denoted in the three triangles in FIG. 2*b*) where the signal line wire intersects the video signal line 212 and lines 2311, 2312 connecting the buffer unit 231 and the plurality of switch units 221, 222, 223. The parasitic capacitance per pixel length on the video lines 212 comes from crossover points 421, 422, 423 (as denoted in the three squares in FIG. 2*b*) where the signal line wire intersects the buffer unit 231 and the lines 2311, 2312 connecting the plurality of switch units 221, 222, 223. The parasitic capacitance per pixel length on the video line 213 comes from crossover points 431, 432, 433 (as denoted in the three hexagons in FIG. 2*b*) where the signal line wire intersects the output signal lines 2211, 2221, 2231 of the plurality of switch units 221, 222, 223. Therefore, within a pixel length each video line has a parasitic capacitance from three crossover points for this embodiment. FIG. 3*a* shows a schematic diagram of the driving circuit for sample/sustenance according to the second embodiment of the present invention. The components and the line connections of the second embodiment are similar to those of the first embodiment, except a plurality of switch units 321, 322, 323 disposed between a video signal line 313 (for providing an analogous video signal for green) and a video signal line 311 (for providing an analogous video signal for blue) as well as two video signal lines 311, 312 used to space the plurality of switch units 321, 322, 323 from an active aroa (display arop) a display area 341.

Figure 3B:
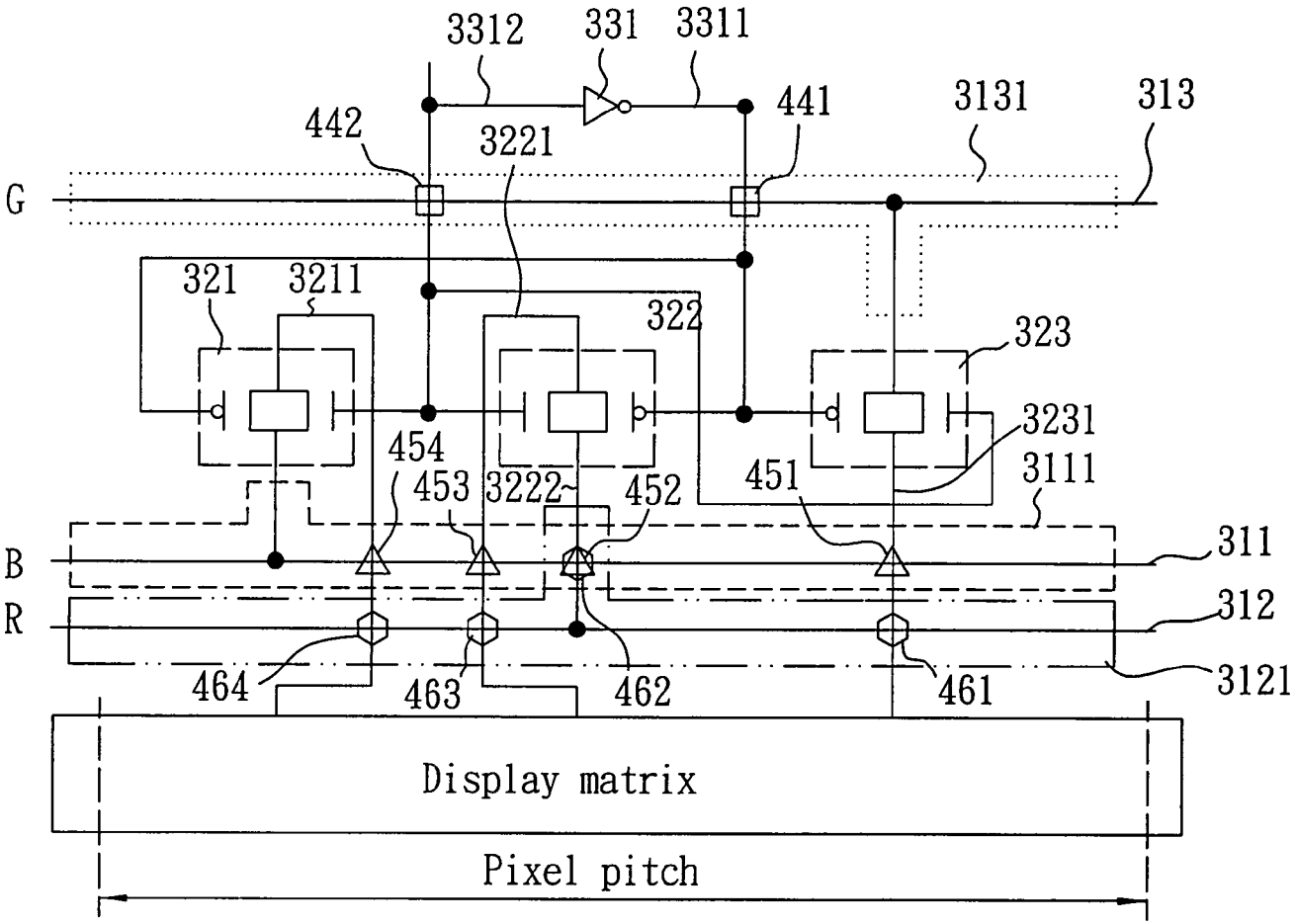
FIG. 3*b* is a schematic diagram of the parasitic capacitances associated with the second embodiment of the present invention.

FIG. 3*b* shows a schematic diagram of the parasitic capacitances associated with the second embodiment of the present invention. The parasitic capacitance per pixel length on the video line 311 is due to crossover points 451, 452, 453, 454 (as denoted in four triangles in FIG. 3*b*) where the signal line wire intersects output signal lines 3211, 3221, 3231 of the plurality of switch units 321, 322, 323 and a line 3222 connecting the switch unit 322 to the video signal line 312. The parasitic capacitance per pixel length on the video line 312 is due to crossover points 461, 462, 463, 464 (as denoted in four hexagons in FIG. 3*b*) where the signal line wire intersects the output signal lines 3211, 3221, 3231 of the plurality of switch units 321, 322, 323 and the video signal line 311. The parasitic capacitance per pixel length on the video line 313 is due to crossover points 441, 442 (as denoted in two squares in FIG. 3*b*) where the signal line wire intersects lines 3311, 3312 connecting the buffer unit 331 and the plurality of switch units 321, 322, 323.

FIG. 4 is a comparison table of the number of the crossover points per pixel length on the video lines according to whether the conventional driving circuit or the driving circuit according to the present invention is used. As shown in this table, 12 crossover points (i.e., 4 crossover points for each video line) within one pixel length are associated with the conventional driving circuit while only nine crossover points (i.e., 3 crossover points for each video line) within one pixel length are associated with the layout according to the first embodiment of the present invention and 10 parasitic capacitances within one pixel length are associated with the layout according to the second embodiment of the present invention. Therefore, the circuit of the present invention can decrease the amount of the parasitic capacitance on video lines, improve picture quality at high video sampling rate, and decrease dynamic power dissipation on video lines.

Although the present invention has been explained in relation to its preferred embodiment, it is to be understood that many other possible modifications and variations can be made without departing from the spirit and scope of the invention as hereinafter claimed.

What is claimed is:

1. A driving circuit for a flat display panel, said flat display panel including a display area, comprising:

a first video signal line for providing video signals;

a second video signal line for providing video signals;

a third video signal line for providing video signals;

at least one buffer unit for inverting a scanning signal;

a first switch unit disposed between said first video signal line and said third video signal line;

a second switch unit disposed between said first video signal line and said third video signal line;

a third switch unit disposed between said first video signal line and said third video signal line, and said first, second, third switch units and said display area of said flat display panel being spaced apart with said third video signal line being between said switch units and said display area; and wherein said first switch unit is connected to said first video signal line to receive a video signal and is connected to said buffer unit to receive said scanning signal inverted by said buffer unit, said second switch unit is connected to said second video signal line to receive a video signal and is connected to said buffer unit to receive said scanning signal inverted by said buffer unit, said third switch unit is connected to said third video signal line to receive a video signal and is connected to said buffer unit to receive said scanning signal inverted by said buffer unit, and said scanning signal controls output of said video signals by said first switch unit, said second switch unit, and said third switch unit to said display area of said flat display panel.

2. The driving circuit of claim 1, wherein said video signals includes analog video signals.

3. The driving circuit of claim 1, wherein said buffer unit for inverting a scanning signal is an inverting circuit receiving a timing signal which is then inverted to output at least one scanning signal.

4. The driving circuit of claim 2, wherein said at least one scanning signal is an inversed signal of said timing signal.

5. The driving circuit of claim 1, wherein said first switch unit, said second switch unit, and said third switch unit comprise thin-film transistors.

6. The driving circuit of claim 1, wherein said first video signal line is disposed between said first switch unit and said buffer unit for inverting a scanning signal.

7. The driving circuit of claim 1, wherein said third video signal line is disposed between said first, second, third switch units and said display area.

8. The driving circuit of claim 1, wherein said flat display panel comprises a liquid crystal display panel.

9. A driving circuit for a flat display panel, said flat display panel including a display area, comprising:

a plurality of video signal lines for providing video signals;

at least one buffer unit for inverting a scanning signal; and a plurality of switch units disposed between said plurality of video signal lines, and said plurality of switch units and said display area of said flat display panel being spaced apart with at least one video signal line between the switch units and the display area, wherein each of said plurality of switch units is connected to at least one video signal line to receive a video signal and is connected to said buffer unit to receive said scanning signal inverted by said buffer unit, and said scanning signal controls output of said video signals by the plurality of switch units to said display area of said flat display panel.

10. The driving circuit of claim 9, wherein said video signals include analog video signals.

11. The driving circuit of claim 9, wherein said buffer unit for inverting a scanning signal is an inverting circuit receiving a timing signal which is then inverted to output at least one scanning signal.

12. The driving circuit of claim 10, wherein said at least one scanning signal is an inversed signal of said timing signal.

13. The driving circuit of claim 9, wherein said plurality of switch units comprise thin-film transistors.

14. The driving circuit of claim 9, wherein said at least one video signal line is disposed between said plurality of switch units and said buffer unit for inverting a scanning signal.

15. The driving circuit of claim 9, wherein said plurality of video signal lines are disposed between said switch units and said display area.

16. The driving circuit of claim 9, wherein said flat display panel comprises a liquid crystal display panel.

* * * * *